US006016640A

United States Patent [19]

Finkowski et al.

[11] Patent Number: 6,016,640

[45] Date of Patent: Jan. 25, 2000

[54] DETACHABLE SPOON FOR A DOUGH PACKING MACHINE

[75] Inventors: James W. Finkowski, Andover; Robert F. Meyer, Maple Grove, both of Minn.

[73] Assignee: The Pillsbury Company, Minneapolis, Minn.

[21] Appl. No.: 09/072,438

[22] Filed: May 4, 1998

[51] Int. Cl.[7] ..... B65B 25/16; B65B 39/06; B65B 39/14

[52] U.S. Cl. ..... 53/255; 53/257; 53/260; 53/570

[58] Field of Search ..... 53/255, 257, 260, 53/258, 566, 570, 253, 252, 251, 235, 390, 391, 392, 468, 467, 473

[56] References Cited

U.S. PATENT DOCUMENTS

| | | | |
|---|---|---|---|
| 945,572 | 1/1910 | Murray | 53/255 |
| 3,161,003 | 12/1964 | Grintz | 53/255 |
| 3,270,485 | 9/1966 | Knepper | 53/255 |
| 3,458,970 | 8/1969 | Reid et al. | 53/159 |
| 4,716,714 | 1/1988 | Tisma | 53/575 |
| 4,982,556 | 1/1991 | Tisma | 53/251 X |
| 5,048,266 | 9/1991 | Wieckowicz | 53/469 |
| 5,685,127 | 11/1997 | Finkowski | 53/255 |

FOREIGN PATENT DOCUMENTS

WO 93/21068 10/1993 WIPO .

*Primary Examiner*—James F. Coan
*Attorney, Agent, or Firm*—Westman, Champlin & Kelly

[57] ABSTRACT

An apparatus for loading dough product into a container through a container opening includes a spoon assembly and a carriage. The spoon assembly includes a support rail and a spoon joined to the support rail, the spoon having a discharge opening. A container holder is also joined to the support rail. The container holder supports the container proximate the discharge opening. The carriage detachably receives the support rail at at least two spaced-apart positions.

19 Claims, 8 Drawing Sheets

26A
26
38
60
10
27B
28
20
27
27A
31A
12
50
74
31B
37
69B
80
70
82
98
96
76
37
80
88
98
96
76
84
69A
27A
27
70
74
86
38
60
26A
26
26B
28
20

DETACHABLE SPOON FOR A DOUGH PACKING MACHINE

BACKGROUND OF THE INVENTION

The present invention relates to continuous dough processing lines. More particularly, the present invention relates to an apparatus for inserting or packing dough into containers.

Apparatuses for inserting dough into containers are generally known. U.S. Pat. No. 3,458,970 to Reid, et al., discloses one such packing apparatus. The dough packing apparatus of Reid, et al., includes a mechanism for rolling and slitting a dough sheet to form a plurality of longitudinally aligned adjacent rolls of dough; and a receiving mechanism for grouping the dough pieces, for example, in pairs, and for providing a predetermined space in between single pieces. In a form of the apparatus, the receiving mechanism includes a pair of vertically spaced endless conveyors with receiving cups on one side of the edges of the lower conveyor for initially holding the pieces. An upper conveyor is obliquely mounted and is adapted to contact the upper surfaces of the pieces located in the cups when they have reached a predetermined position, and thereafter roll them to the lower conveyor to the opposite edge thereof. From the edge of the lower conveyor, the dough pieces fall to an indexing drum which, in turn, retains them for a predetermined period of time and then transfers them to one of several supporting and guiding spoons mounted on an endless loading conveyor. A container dispenser provides containers to the loading conveyor which includes a provision for supporting the containers in position to receive the rolls from the spoons.

The spoons are arranged on the conveyor so as to lie generally perpendicular to the conveying direction. Specifically, fixed plates are mounted to the endless conveyor along each edge. A hinge mounts a supporting bracket to each of the plates. The supporting bracket supports a spoon generally over each respective plate. A container support is mounted to the supporting bracket at a discharge end of the spoon. A follower is secured to a free end of the supporting bracket remote from the hinge. The follower engages a stationary guide rail provided along the frame of the dough packing apparatus. The stationary guide rail includes bends such that its position varies with respect to the support frame along the longitudinal length of the support frame. The stationary guide rail controls the position of the follower and, thus, the support bracket attached thereto, so that as the follower rises and falls following the guide rail, the support bracket pivots on the hinge to tilt the spoon between an elevated position and a retracted position.

Although the general use of tilting spoons mounted to an endless conveyor to load dough pieces into containers performs satisfactorily, there is a need for a more robust machine that will operate faster to allow increased production speeds.

SUMMARY OF THE INVENTION

An apparatus for loading dough product into a container through a container opening includes a spoon assembly and a carriage. The spoon assembly includes a support rail and a spoon joined to the support rail, the spoon having a discharge opening. A container holder is also joined to the support rail. The container holder supports the container proximate the discharge opening. The carriage detachably receives the support rail at at least two spaced-apart positions.

DETAILED DESCRIPTION OF THE PREFERRED EMBODIMENTS

Figure 1:
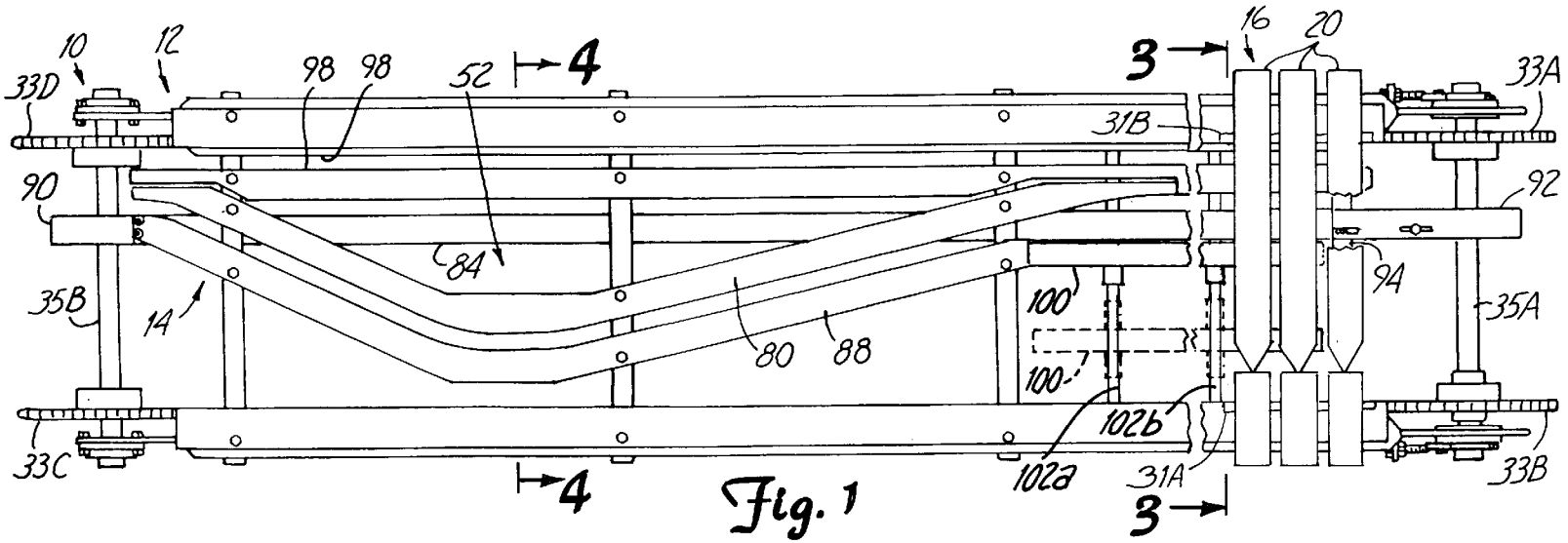
FIG. 1 is a top plan view of a dough packing apparatus of the present invention with portions removed.
Figure 2:
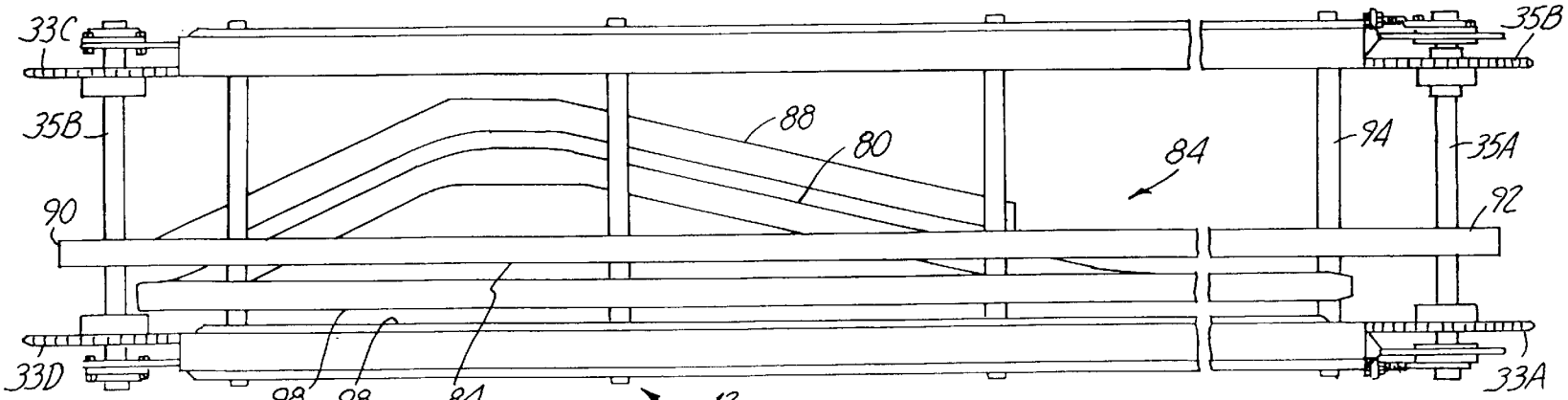
FIG. 2 is a bottom plan view of the dough packing apparatus with portions removed.

FIGS. 1–4 illustrate an embodiment of a dough packing apparatus 10 incorporating the present invention. Generally, the dough packing apparatus 10 includes a support frame 12 having a cam rail 14, and an endless conveyor 16 that is rotatable on the support frame 12. The endless conveyor 16 is formed of a plurality of tilting spoon assemblies 20. In FIG. 1, most of the tilting spoon assemblies 20 have been removed in order to show other components of the dough packing apparatus 10. Preferably, a sufficient number of tilting spoon assemblies 20 are provided on the endless conveyor 16 so as to cover the endless conveyor 16 and allow continuous operation.

Figure 3:
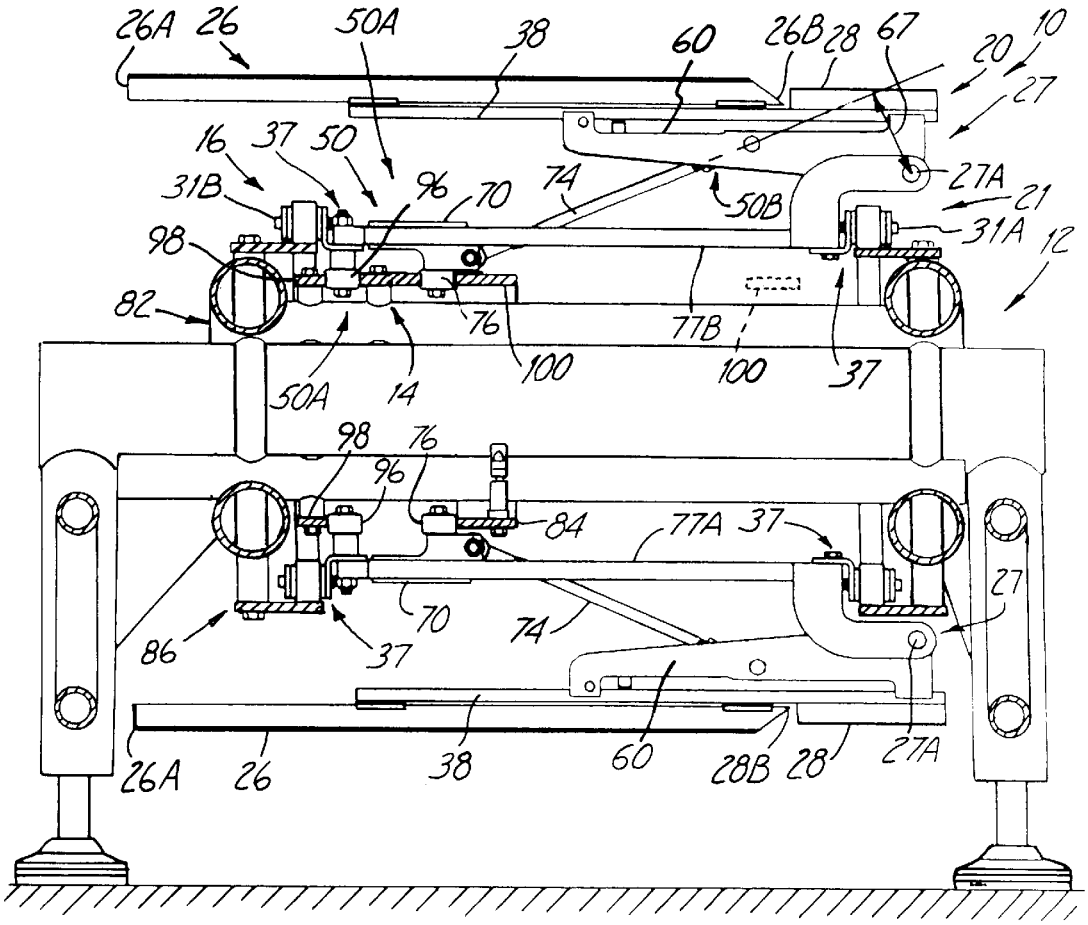
FIG. 3 is a sectional view of the dough packing apparatus, illustrating a tilting spoon in a retracted position.

Referring to FIG. 3, each tilting spoon assembly 20 includes a support member 21 secured to endless conveyor 16, a spoon 26, and a hinge 27 joining the support member 21 to the spoon 26. In the embodiment illustrated, the endless conveyor 16 comprises endless chains 31A and 31B disposed on opposite sides of the support frame 12. The chains 31A and 31B rotate on sprockets 33A, 33B, 33C, and 33D (FIG. 1) wherein sprockets 33A and 33B and sprockets 33C and 33D are joined together by common shafts 35A and 35B, respectively. A suitable driver device, such as an electric motor, drives one of the shafts 35A or 35B to rotate the endless conveyor 16. Each of the support members 21 is joined at opposite ends to the chains 31A and 31B with suitable mounting assemblies 37.

Figure 5:
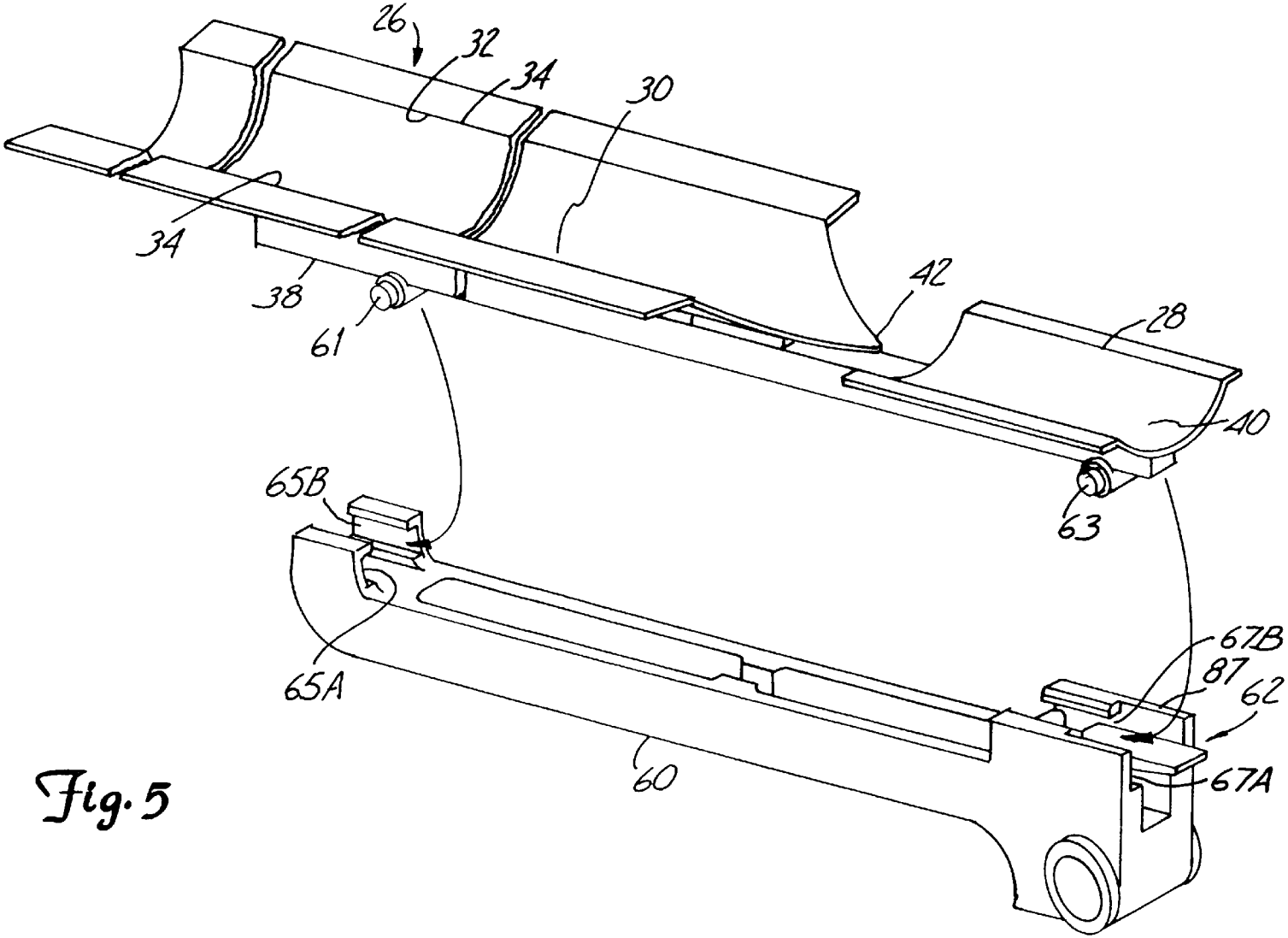
FIG. 5 is an exploded view of a tilting spoon.

Referring to FIG. 5, the spoon 26 is an elongated open trough having a longitudinal axis oriented generally perpendicular to the conveying direction when mounted to the support member 21. Dough to be packaged into a container is placed upon a lower surface 30 of the spoon 26 through an opening 32 formed between spaced-apart side walls 34 extending from the lower surface 30. In the embodiment illustrated, the spoon 26 is supported on a support rail 38 that also supports a container holder 28 which is aligned with the spoon 26 and mounted to the support rail 38. Preferably, the support rail 38 elevates the lower surface 30 of the spoon 26 above a lower surface 40 of the container holder 28 such that an extending tang 42 of the lower surface 30 can be inserted within an opening of a container (not shown) when the container has been placed on the container holder 28. An embodiment of the spoon 26 with the extending tang 42 is described in U.S. Pat. No. 5,685,127, entitled "UNIVERSAL SPOON FOR LOADING DOUGH INTO CONTAINERS," issued on Nov. 11, 1997, which is hereby incorporated by reference.

Figure 4:
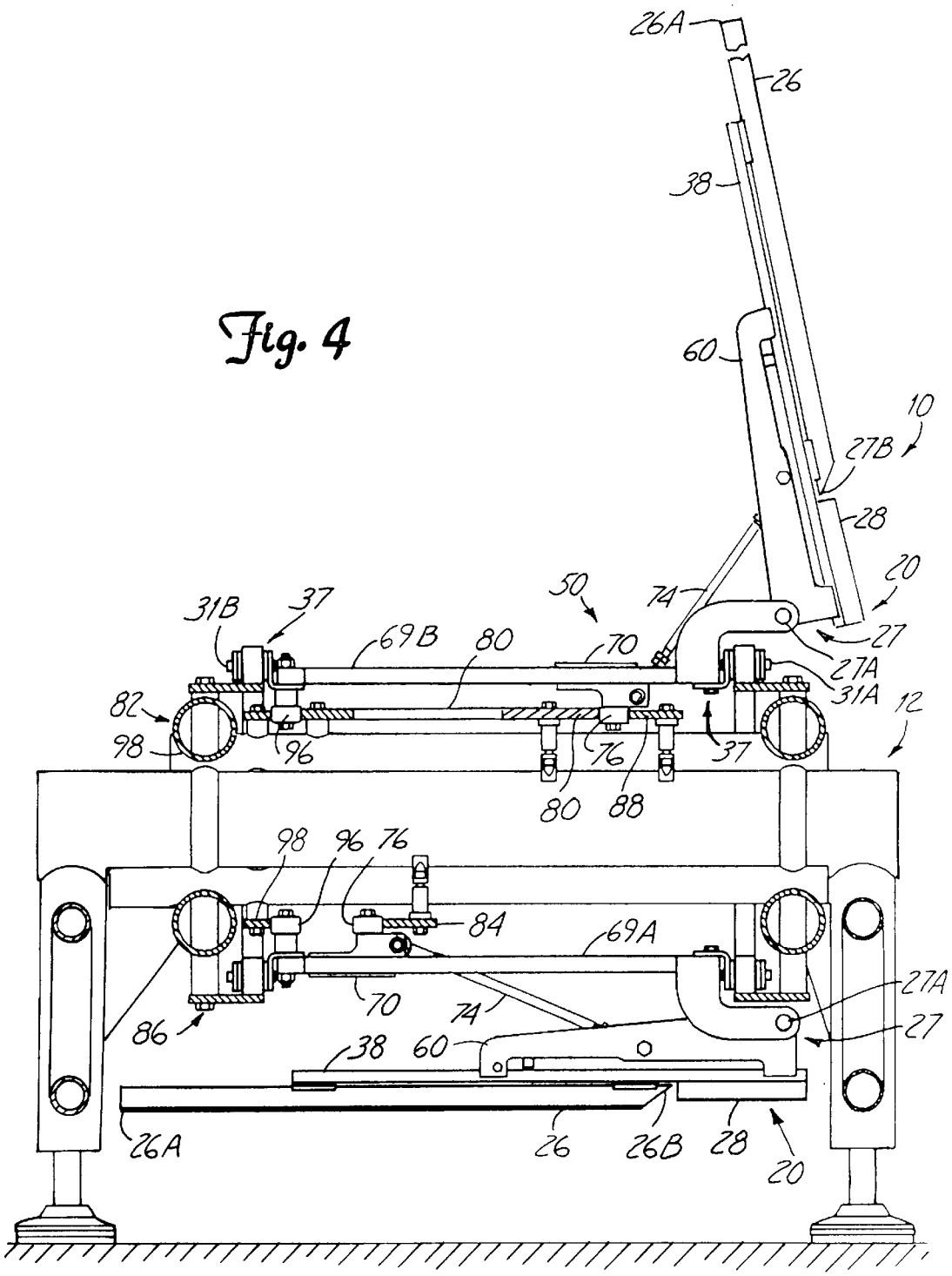
FIG. 4 is a sectional view of the dough packing apparatus with a tilting spoon in a tilted position.

As illustrated in FIGS. 3 and 4, a push bar assembly 50 controls the pivoting motion of the support spoon 26. In particular, the push bar assembly 50 lifts each respective spoon 26 from a first or retracted position (FIG. 3) to a second or tilted position (FIG. 4). Each push bar assembly 50 includes a first end 50A and a second end 50B. The end 50A engages the cam rail 14. The cam rail 14 includes bends which provide a portion 52 (FIG. 1) that causes displacement of the push bar assembly 50 to tilt the spoon 26 between the retracted position and the tilted position. The end 50B of each push bar assembly 50 is secured, in effect, to the spoon 26.

In the embodiment illustrated, the end 50B is pivotally joined to a carriage 60. The carriage 60 forms one of the pivoting members of the hinge 27 and detachably receives the support rail 38. In a preferred embodiment, the carriage 60 and support rail are rapidly detachable. As used herein, "rapidly detachable" shall mean quick and easy assembly of the support rail to the carriage without undue effort or manipulation with, for example, wrenches or the like. In the embodiment illustrated, the carriage 60 includes a locking mechanism generally indicated at 62 in FIG. 8 that allows rapid detachment of the support rail 38 and the carriage 60.

The hinge 27 includes a pivot pin 27A that joins the carriage 60 to the support member 21. When the support rail 38 is locked in place by the locking mechanism 62 to the carriage 60, the spoon 26 is effectively attached to the push bar assembly 50, wherein the end 50B of the push bar assembly 50 is positioned underneath the spoon 26 between the hinge 27 and an end 26A of the spoon 26 that is remote from a discharge opening 26B for the dough products.

In the embodiment illustrated, the carriage 60 slidably receives the support rail 38. Preferably, the support rail 38 is releasibly joined to the carriage 60 in at least two spaced-apart positions so as to securely join the support rail 38 to the carriage 60. In the embodiment illustrated, enlarged portions 61 and 63, herein embodied as cross-pins, are joined to or formed integrally with the support rail 38. Complimentary channels or grooves 65A and 65B receive the cross-pin 61, while complimentary channels 67A and 67B receive the cross-pin 63. As appreciated by one skilled in the art, if desired, the carriage 60 can include enlarged portions, while the support rail 38 includes complimentary channels. Furthermore, although illustrated wherein the support rail 38 is releasibly joined to the carriage 60 in at least two spaced-apart positions, additional mounting positions can also be included. In addition, the support rail 38 can be slidably received in a single channel formed in the carriage 60 that extends along a substantial portion of the carriage 60. In the present application, a single channel extending over a substantial portion of the carriage 60 is a mounting assembly that releasibly joins the support rail to the carriage 60 at at least two spaced-apart positions. In the embodiment illustrated, the support rail 38 is joined to the carriage 60 at a position below the spoon 26 and at a position below the container holder 28 in order to ensure rigidity.

Figure 8:
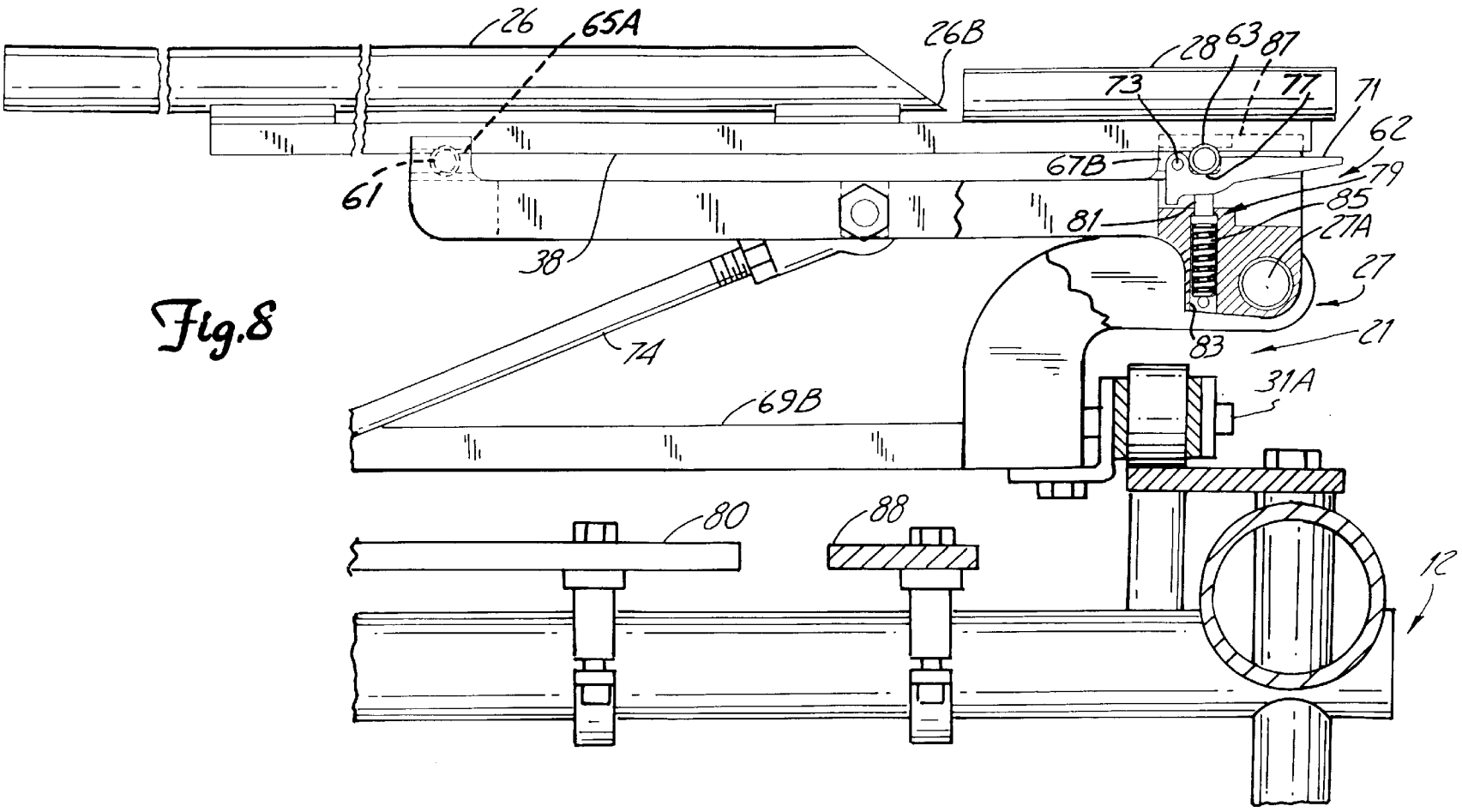
FIG. 8 is an enlarged sectional view of FIG. 3.

Referring to FIG. 8, the locking mechanism 62 comprises a pivoting lever 71 that releasibly engages the support rail 38. A cross-pin 73 mounts the lever 71 to the carriage 60. The cross-pin 73 extends between the channel 67A and 67B. The lever 71 includes a recess 77 for receiving the cross-pin 63. A biasing mechanism 79 biases the lever 71 upwardly so as to lock the support rail 38 to the carriage 60 and, in particular, to maintain the cross-pin 63 within the channels 67A and 67B. The biasing mechanism 79 includes a pin 81 slidably mounted in a bore 83 provided in the carriage 60 proximate the pin 27A. A spring 85 also disposed in the bore 83 urges the pin 81 into engagement with the lever 71.

In operation, the support rail 38, with the spoon 26 and the container holder 28 attached thereto, is joined to the carriage 60 by aligning the cross-pin 61 with the channels 65A and 65B. Similarly, the cross-pin 63 is aligned with the channels 67A and 67B wherein the cross-pin 63 can drop through an enlarged recess 87 provided in the carriage 60. Longitudinal movement of the support rail 38 in the carriage 60 is limited by engagement of the cross-pin 63 with a portion of the lever 71 proximate the cross-pin 73. The contact aligns the cross-pin 63 with the recess 77 where the lever 71 is urged upwardly by the biasing mechanism 79. Mounting the spoon 26 and container holder 28 to the support rail 38 and releasibly mounting the support rail 38 to the carriage 60 allows quick and easy replacement of the spoons 26 on the endless conveyor 16 when necessary. In particular, each of the spoons 26 can be replaced quickly with spoons having a larger or smaller diameter when it is desired that a different dough product be packaged.

Figure 6:
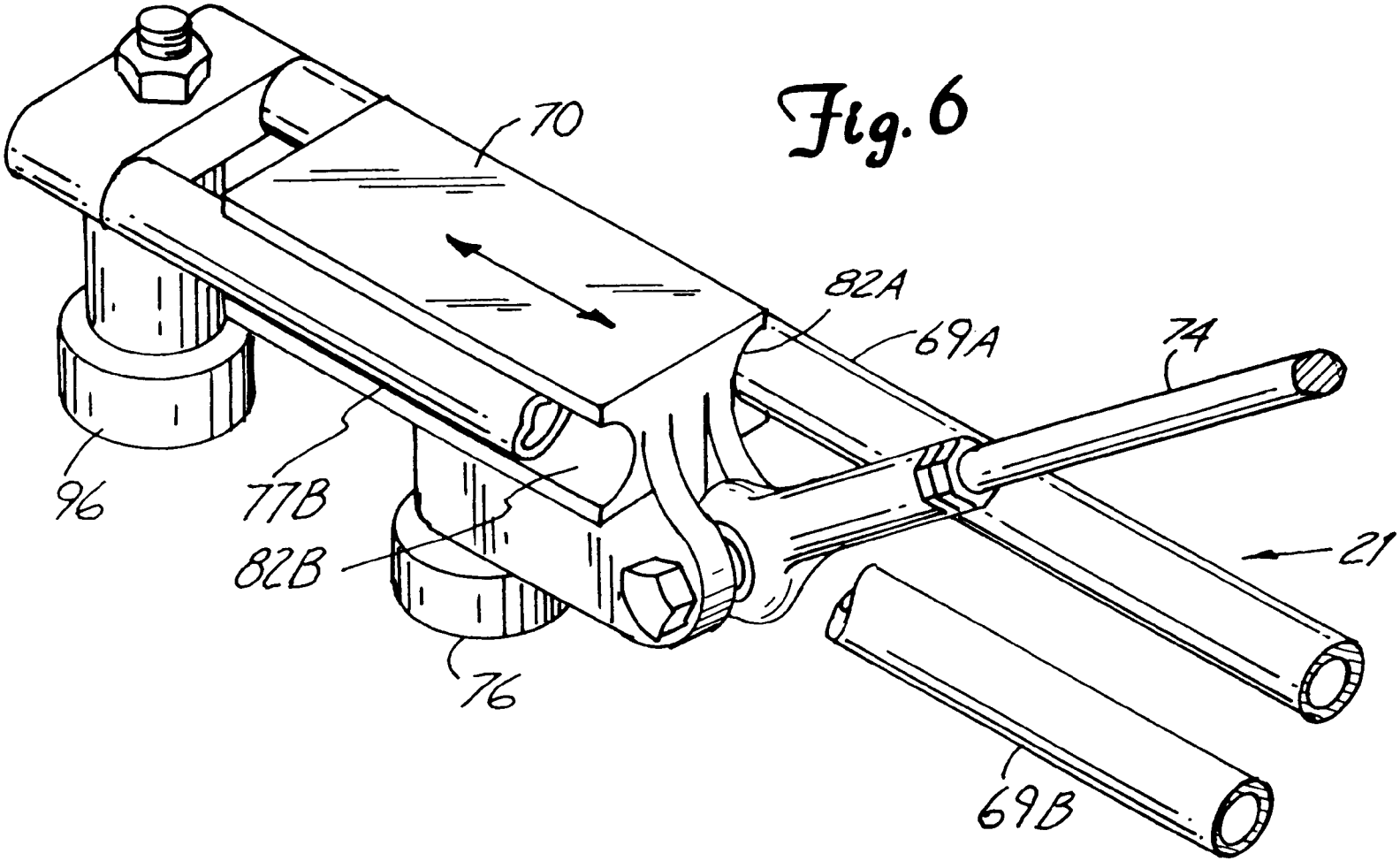
FIG. 6 is perspective view of a pusher bar assembly with portions removed.
Figure 7:
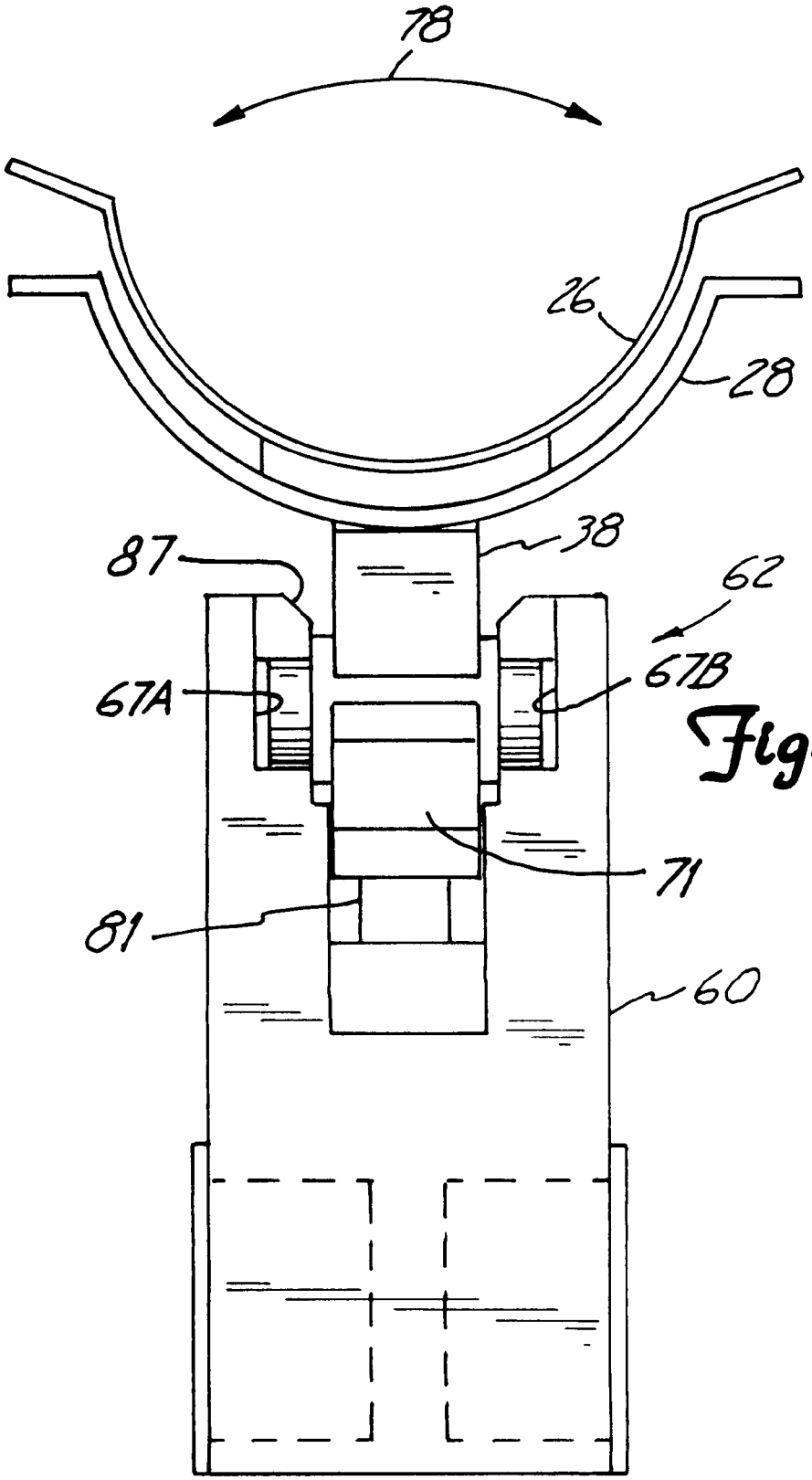
FIG. 7 is an end view of a tilting spoon.

In the illustrative embodiment of FIG. 6, the push bar assembly 50 includes an end member 70 (herein embodied as a slide assembly) and a push bar 74. The slide assembly 70 slides upon the support member 21 and includes a guide roller 76 that engages the cam rail 14. The push bar 74 is pivotally joined to the slide assembly 70 to allow the push bar 74 to pivot with tilting movement of the associated spoon 26. In a preferred embodiment, the slide assembly 70 and the support member 21 are designed to inhibit rocking motion of the spoon 26 on the support member 21 in directions indicated generally by double arrow 78 in FIG. 7. In particular, the cam rail 14 in the portion 52 (FIG. 1) is of sufficient length so as to gradually lift the spoon 26 from the retracted position of FIG. 3 to the tilted position of FIG. 4. By lengthening out the portion 52 of the cam rail 14 that lifts the spoon 26 to the tilted position, the angular speed of the spoon 26 is reduced.

In the embodiment illustrated in FIG. 6, the support member 21 includes two parallel spaced-apart rods 69A and 692. The rods 69A and 69B are slidably disposed in recesses 82A and 82B (which could also be bores), respectively, provided in the slide assembly 70. The push bar 74 extends between the rods 69A and 69B.

Referring back to FIGS. 1–4, the cam rail 14 preferably includes a first cam rail portion 80 disposed on an upper section 82 of the support frame 12, and a second cam rail portion 84 disposed on a lower section 86 of the support frame 12. As illustrated, the rail portion 80 includes the portion 52, which causes displacement of the slide assembly 70 in order to tilt or lift the spoons 26. A rail portion 88 is spaced-apart from the rail portion 80. At high operating speeds, the guide roller 76 may have a tendency to disengage from the rail portion 80 due to angular momentum of the spoon 26 and associated components. The rail portion 88 is in parallel with the rail portion 80 in the portion 52 to trap the guide roller 76 therebetween and inhibit substantial movement of the guide roller 76 away from the rail portion 80.

Figure 9:
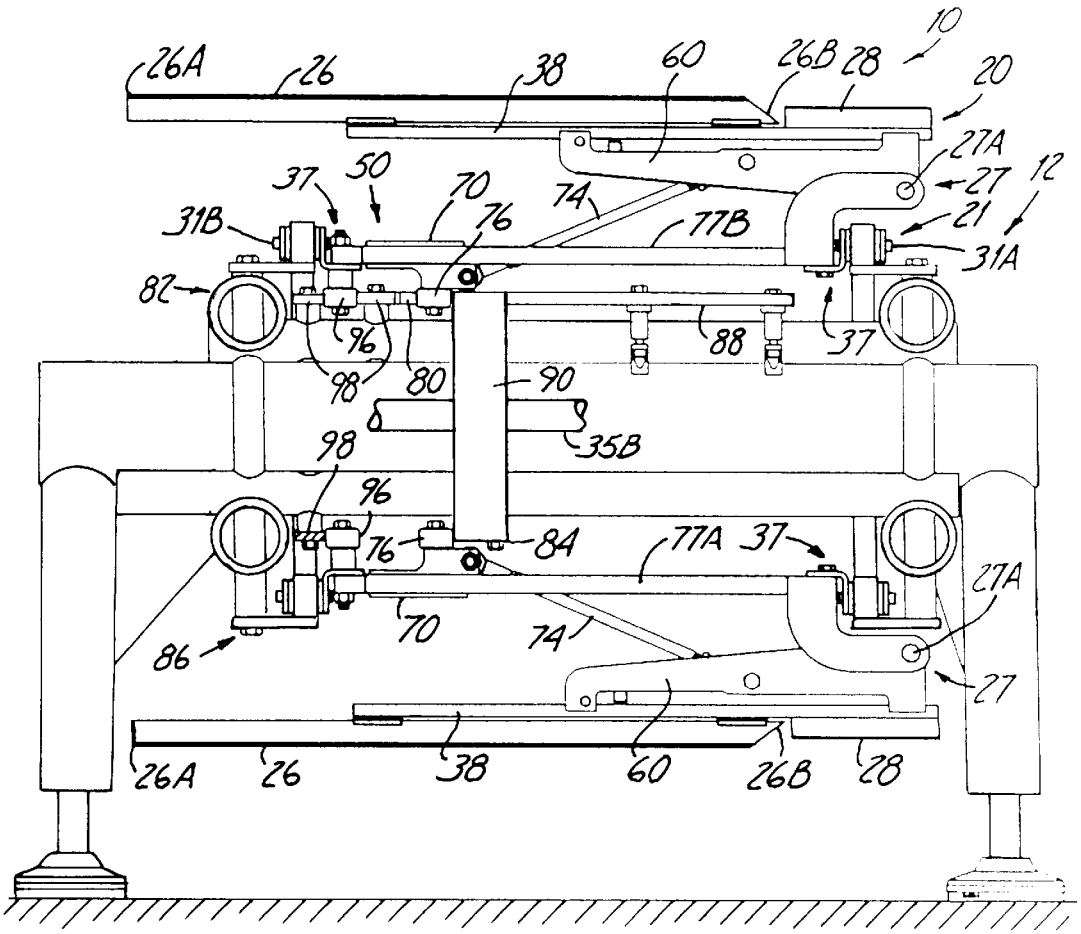
FIG. 9 is a side elevational view of the dough packing apparatus with portions removed.

The lower rail portion 84 retains the spoons 26 in the retracted position (FIG. 3) against the force of gravity as the spoon assemblies 20 are conveyed upside down on the support frame 12. Referring to FIGS. 1 and 9, the lower rail portion 84 and the upper rail portion 80 are joined together by end rail portion 90, which bends around shaft 35B. In this manner, the rollers 76 remain in continuous contact with the cam rail 14 to hold the spoons 26 in the retracted position. A similar end portion 92 is provided around shaft 35A, which, in the embodiment illustrated, is integrally formed with portion 84.

In the embodiment illustrated, a second guide roller 96 is secured to at least some of the support members 21 at spaced-apart intervals. The guide rollers 96 engage parallel guide rails 98. The guide rollers 96 help maintain the support members 21 and the spoons 26 attached thereto substantially normal to the conveying direction during planar movement in the conveying direction on the upper section 82 and during planar movement in a direction opposite to the conveying direction on the lower section 86.

The cam rail 14 is described in detail in the co-pending application Ser. No. 09/072,438 entitled "DOUGH PACKING MACHINE WITH TILTABLE SPOONS" filed on even date herewith, which is incorporated herein by reference.

Although the present invention has been described with reference to preferred embodiments, workers skilled in the art will recognize that changes may be made in form and detail without departing from the spirit and scope of the invention.

What is claimed is:

1. An apparatus for loading a dough product into a container through a container opening, the apparatus comprising:

a spoon assembly comprising:

a support rail;

a spoon joined to the support rail and having a discharge opening; and a container holder joined to the support rail capable of supporting the container proximate the discharge opening; and a carriage detachably receiving the support rail at at least two positions.

2. The apparatus of claim 1 wherein the carriage detachably receives the support rail at a position below the spoon and at a position below the container holder.

3. The apparatus of claim 1 and further comprising a lock mechanism operably coupling the support rail to the carriage.

4. The apparatus of claim 3 wherein the lock mechanism includes an engaging member movably secured to the carriage to releasably engage the support rail.

5. The apparatus of claim 4 wherein the engaging member is a pivotal lever.

6. The apparatus of claim 4 wherein the support rail includes an enlarged portion and the engaging member releasably engages the enlarged portion.

7. The apparatus of claim 4 wherein the lock mechanism includes a means for biasing the engaging member.

8. The apparatus of claim 1 wherein one of the support rail and the carriage includes a channel and the other includes a complementary member slidably received in the channel.

9. The apparatus of claim 8 wherein the channel is provided in the carriage.

10. The apparatus of claim 9 wherein the complementary member comprises an enlarged portion formed on the support rail.

11. The apparatus of claim 10 wherein the carriage includes a recess and the channel opens to the recess, the recess being of size to receive the enlarged portion.

12. The apparatus of claim 11 wherein the support rail includes a second enlarged portion spaced-apart from the first-mentioned enlarged portion, and wherein the carriage includes a second channel for receiving the second enlarged portion, and wherein the recess is located between the second channel and the first-mentioned channel.

13. The apparatus of claim 1 and further comprising an endless conveyor and a support member mounted to the endless conveyor substantially normal to a conveying direction, and wherein the carriage is pivotally joined to the support member.

14. An apparatus for loading dough into a container through a container opening, the apparatus comprising:

a support frame;

an endless band rotatable on the support frame; and a plurality of tilting spoon assemblies mounted to the band, each tilting spoon assembly comprising:

a support member joined to the band;

a support rail;

a spoon joined to the support rail and having a discharge opening; and a container holder joined to the support rail capable of supporting the container proximate the discharge opening; and a carriage pivotally mounted to the support member, the carriage detachably receiving the support rail at AT least two positions.

15. The apparatus of claim 14 wherein the carriage detachably receives the support rail at a position below the spoon and at a position below the container holder.

16. The apparatus of claim 14 wherein each spoon assembly further comprises a lock mechanism operably coupling the support rail to the carriage.

17. The apparatus of claim 16 wherein the lock mechanism includes an engaging member movably secured to the carriage to releasably engage the support rail.

18. The apparatus of claim 17 wherein the engaging member is a pivotal lever.

19. The apparatus of claim 14 wherein the endless band comprises two spaced-apart chains, and wherein each support member is joined at opposite ends to the chains.

* * * * *